US010107284B2

(12) United States Patent
Sun

(10) Patent No.: US 10,107,284 B2
(45) Date of Patent: Oct. 23, 2018

(54) CHECK VALVE FOR PUMP

(71) Applicant: SHANP-YIH PRECISION INDUSTRIAL CO., LTD., Taichung (TW)

(72) Inventor: Chih-Chung Sun, Taichung (TW)

(73) Assignee: SHANP-YIH PRECISION INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/386,804

(22) Filed: Dec. 21, 2016

(65) Prior Publication Data

US 2018/0171998 A1 Jun. 21, 2018

(51) Int. Cl.

| | |
|---|---|
| ***F04B 53/10*** | (2006.01) |
| ***F04B 53/16*** | (2006.01) |
| ***F04B 53/06*** | (2006.01) |
| ***F04B 19/22*** | (2006.01) |
| ***F04B 53/14*** | (2006.01) |
| ***B05B 11/00*** | (2006.01) |

(52) U.S. Cl.

CPC ..... *F04B 53/1072* (2013.01); *B05B 11/0016* (2013.01); *B05B 11/3001* (2013.01); *F04B 19/22* (2013.01); *F04B 53/06* (2013.01); *F04B 53/144* (2013.01); *F04B 53/16* (2013.01)

(58) Field of Classification Search

CPC .... F04B 53/1072; F04B 53/06; F04B 53/144; F04B 53/16; F04B 19/22; B05B 11/0016; B05B 11/3001

USPC ..... 222/321.7–321.9, 336–342, 383.1

See application file for complete search history.

(56) References Cited

U.S. PATENT DOCUMENTS

| | | | | | |
|---|---|---|---|---|---|
| 5,725,128 | A * | 3/1998 | Foster | B05B 11/3001 | 222/153.13 |
| 5,806,721 | A * | 9/1998 | Tada | B05B 11/3001 | 222/153.13 |
| 5,842,605 | A * | 12/1998 | Lehmkuhl | B05B 11/0043 | 222/95 |
| 6,332,561 | B1 * | 12/2001 | Garcia | B05B 11/0005 | 222/321.3 |
| 6,685,062 | B1 * | 2/2004 | Ki | B05B 11/3025 | 222/321.7 |
| 7,431,181 | B2 * | 10/2008 | Masuda | B05B 11/007 | 222/256 |
| 7,938,298 | B2 * | 5/2011 | Lee | B05B 11/3023 | 222/321.1 |
| 8,631,976 | B2 * | 1/2014 | Moretti | B05B 11/3008 | 222/321.2 |

(Continued)

*Primary Examiner* — Nicholas J Weiss
*Assistant Examiner* — Andrew P Bainbridge

(57) ABSTRACT

A pump includes a collar, a cylinder and an elastic valve. The collar includes a wall, a tubular insert extending in the wall, and a connective portion formed between the wall and the tubular insert. The cylinder includes first and second open ends, first and second chambers respectively in communication with the first and second open ends, and a neck in communication with the first and second chambers. The elastic valve includes a ring, a plug extending in the ring, and elastic strips formed between the plug and the ring so that the plug is movable relative to the ring. The tubular insert is inserted in the first chamber via the first open end when the cylinder is connected to the wall, and the plug normally blocks the neck to form a first check valve when the elastic valve is connected to the second chamber.

7 Claims, 11 Drawing Sheets

(56) References Cited

U.S. PATENT DOCUMENTS

| | | | | |
|---|---|---|---|---|
| 9,539,597 | B2 * | 1/2017 | Ding | B05B 11/3002 |
| 2005/0000985 | A1 * | 1/2005 | Masuda | B05B 11/0029<br>222/257 |
| 2012/0325862 | A1 * | 12/2012 | Kuwahara | B05B 11/3023<br>222/321.9 |
| 2013/0140332 | A1 * | 6/2013 | Csaszar | B05B 11/0048<br>222/256 |
| 2014/0084027 | A1 * | 3/2014 | Wang | B05B 11/0008<br>222/153.13 |
| 2014/0217124 | A1 * | 8/2014 | Kim | B05B 1/3415<br>222/321.9 |
| 2015/0251203 | A1 * | 9/2015 | Wang | B05B 11/3001<br>222/153.13 |
| 2016/0303602 | A1 * | 10/2016 | Kang | B05B 11/3001 |

* cited by examiner

CHECK VALVE FOR PUMP

BACKGROUND OF INVENTION

1. Field of Invention

The present invention relates to a pump and, more particularly, to a check valve for a pump.

2. Related Prior Art

A bottle or can is often equipped with a pump operable for dispensing liquid from the bottle or can. The liquid can be used for skin care, shower, cleaning and disinfection.

Taiwanese Patent M371789 discloses a conventional pump for dispensing liquid from a bottle. The pump includes a check valve inserted in a reduced section of a valve housing 70. The check valve includes an annular frame 42 elastically connected to a circular membrane 43 that is adapted for closing an aperture 74 made in the reduced section of the valve housing 70. The circular membrane 43 can properly close the aperture 74 only when the circular membrane 43 extends parallel to an annular portion of the housing 70 that extends around the aperture 74. However, the circular membrane 43 is often biased from the proper orientation when the pump is filled with viscous liquid. In this case, leak happens.

The present invention is therefore intended to obviate or at least alleviate the problems encountered in prior art.

SUMMARY OF INVENTION

It is the objective of the present invention to provide a reliable pump.

To achieve the foregoing objective, the pump includes a collar, a cylinder and an elastic valve. The collar includes a wall, a tubular insert extending in the wall, and a connective portion formed between the wall and the tubular insert. The cylinder includes first and second open ends, first and second chambers respectively in communication with the first and second open ends, and a neck in communication with the first and second chambers. The elastic valve includes a ring, a plug extending in the ring, and elastic strips formed between the plug and the ring so that the plug is movable relative to the ring. The tubular insert is inserted in the first chamber via the first open end when the cylinder is connected to the wall, and the plug normally blocks the neck to form a first check valve when the elastic valve is connected to the second chamber.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
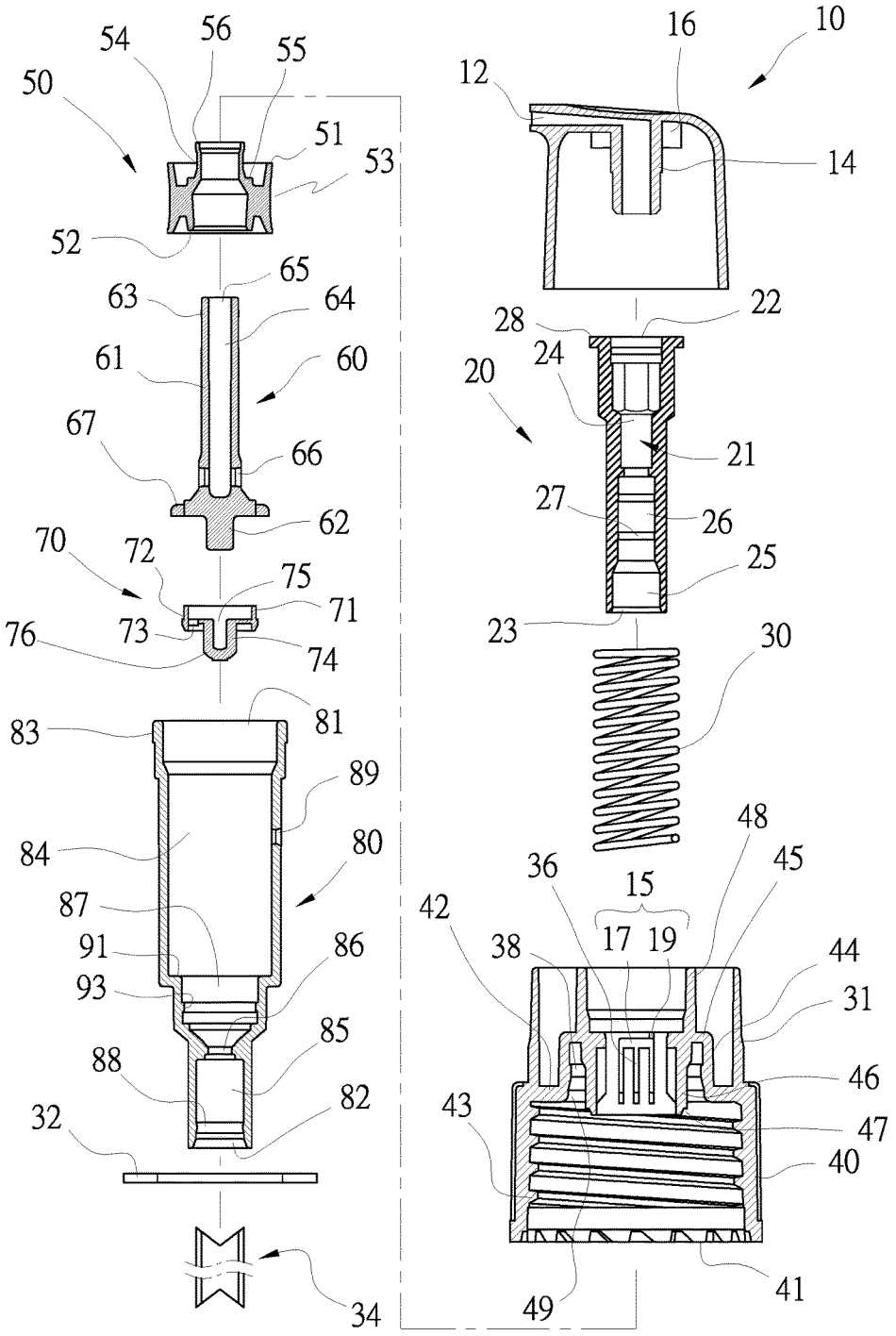
FIG. 1 is an exploded and cross-sectional view of a pump according to the first embodiment of the present invention.

Referring to FIG. 1, a pump includes a nozzle 10, a pipe 20, a spring 30, a washer 32, a tube 34, a collar 40, a piston 50, a piston rod 60, an elastic valve 70 and a cylinder 80 according to a first embodiment of the present invention. The elastic valve 70, the piston rod 60 and the piston 50 are sequentially inserted in the cylinder 80 before the cylinder 80 is inserted partially in and connected to the collar 40. Then, the washer 32 is placed around the cylinder 80 and inserted in the collar 40. The pipe 20 is inserted in the spring 30 before the pipe 20 is connected to the piston rod 60 so that the spring 30 is compressed between the collar 40 and the pipe 20 and that the pipe 20 is biased by the spring 30. The tube 34 is inserted partially in and connected to the cylinder 80. Now, it is desirable to press the pipe 20 several times to determine whether the pump works properly. Finally, the nozzle 10 is connected to the pipe 20 if the pump works properly.

The cylinder 80 is preferably a tubular element that includes two open ends 81 and 82, three chambers 84, 85 and 87, a neck 86 and a vent 89. The open end 81 is made with diameter larger than that of the open end 82. An annular flange 83 extends on an external face of the cylinder 80, near the open end 81. The chamber 84 is in communication with the open end 81. The chamber 85 is in communication with the open end 82. An annular rib 88 is formed on an internal face of the cylinder 80 in the chamber 85. At an end, the chamber 87 is in communication with the chamber 84. The chamber 87 is made with diameter smaller than that of the chamber 84, thus forming a shoulder 91 between them. At another end, the chamber 87 is in communication with the chamber 85 via the neck 86. An annular rib 93 is formed on the internal face of the cylinder 80 in the chamber 87. The vent 89 is made in the periphery of the cylinder 80, in communication with the chamber 84.

Figure 2:
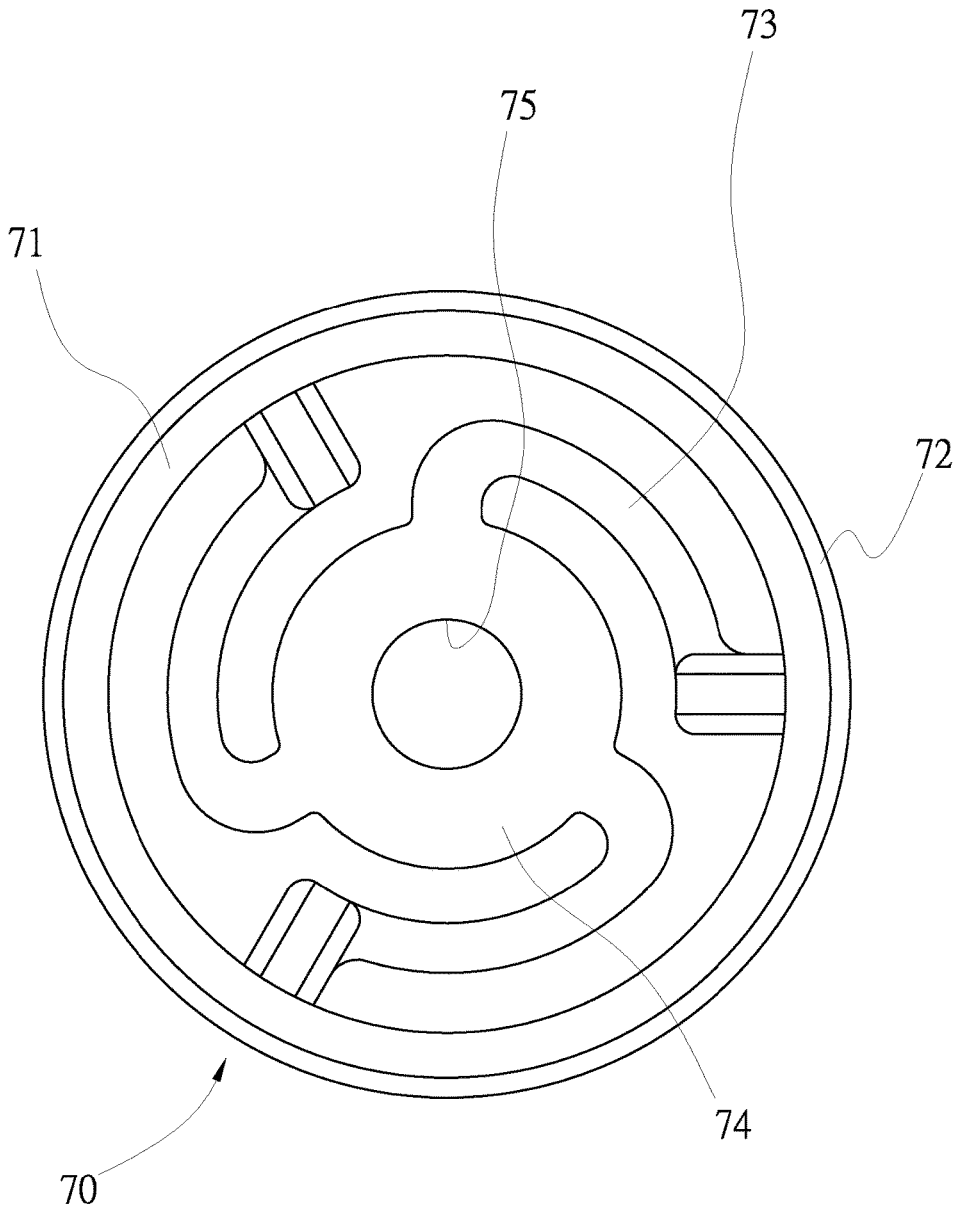
FIG. 2 is a top view of an elastic valve unit used in the pump shown in FIG. 1.

Referring to FIGS. 1 and 2, the elastic valve 70 includes a ring 71, an annular barb 72, three elastic strips 73 and a plug 74. The ring 71, the annular barb 72, the elastic strips 73 and the plug 74 are preferably made in one piece. The annular barb 72 extends on and around an external face of the ring 71. The elastic strips 73 are formed between an external face of the plug 74 and an internal face of the ring 71, thereby rendering the plug 74 axially movable relative to the ring 71. The plug 74 is made with a chamber 75 that includes an open end and a closed end. The plug 74 is made with a convex face 76 at the closed end.

Figure 3:
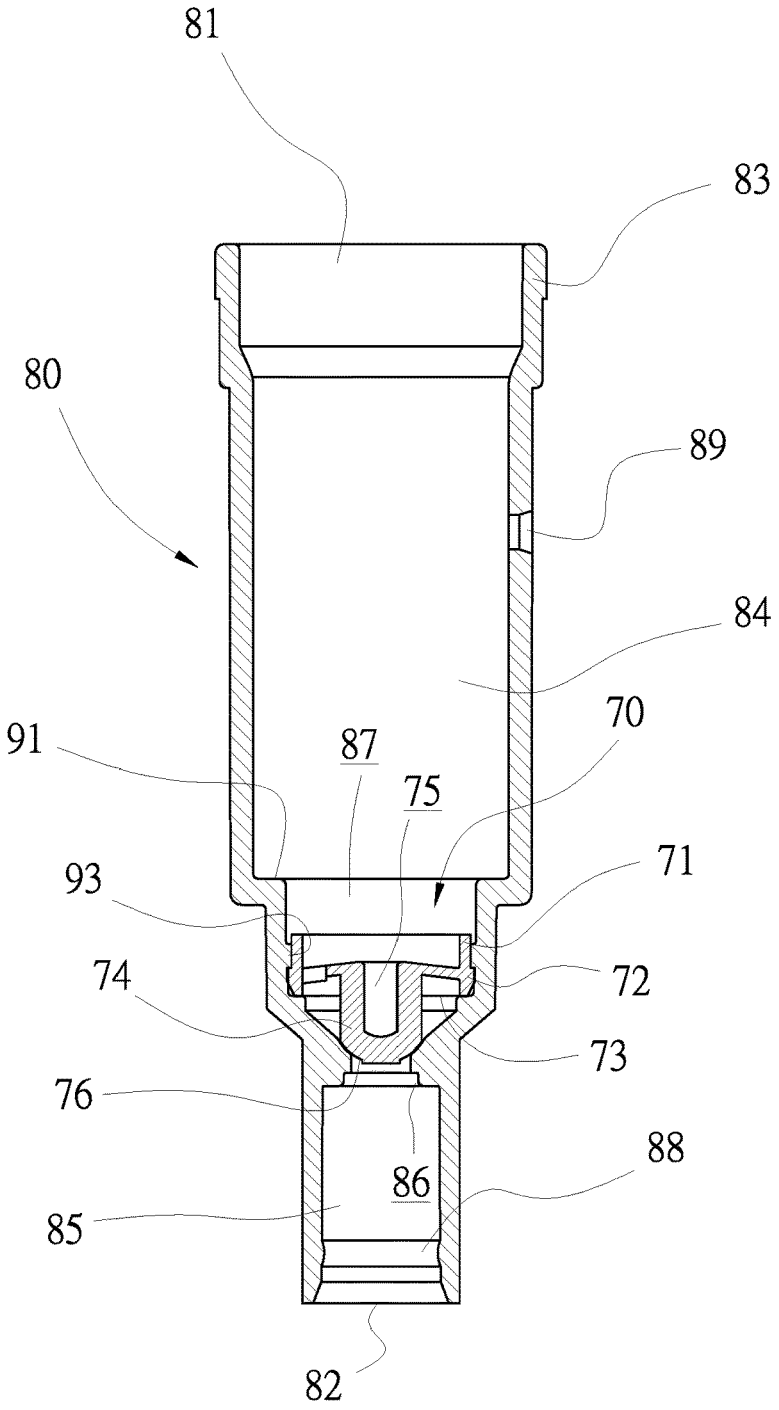
FIGS. 3 to 6 are enlarged and partial views of the pump shown in FIG. 1 in an assembling process.

Referring to FIG. 3, the elastic valve 70 is inserted in the chamber 87 via the chamber 84. The annular barb 72 is forced past and then engaged with the annular rib 93 to keep the elastic valve 70 in the chamber 87. The plug 74 is supported by the elastic strips 73 so that the convex face 76 thereof blocks the neck 86.

Referring to FIG. 1 again, the piston rod 60 includes a hollow section 61 extending from a solid section 62. Two ribs 63 extend on and around an external face of the hollow section 61. The hollow section 61 includes a channel 64, an exit 65 and several entrances 66. The exit 65 is located at an end of the channel 64. The entrances 66 are made in the periphery of the hollow section 61, near another end of the channel 64. The exit 65 is in communication with the entrances 66 via the channel 64. The solid section 62 includes three teeth 67 or more formed thereon.

The piston 50 is an elastic and tough element made of rubber, plastics or polymer for example. The piston 50 is in the shape of a ring that includes an external annular portion 51 extending around an internal annular portion 52. The external annular portion 51 and the internal annular portion 52 are made in one piece. The external annular portion 51 includes a reduced portion between two ends to provide a concave face 53. The piston 50 further includes an axial extensive portion 54 extending from the internal annular portion 52 and a circumferential expansive portion 56 extending from the axial extensive portion 54. The axial extensive portion 54 is made with an external diameter smaller than that of the internal annular portion 52, thereby forming a shoulder 55 between them.

Figure 4:
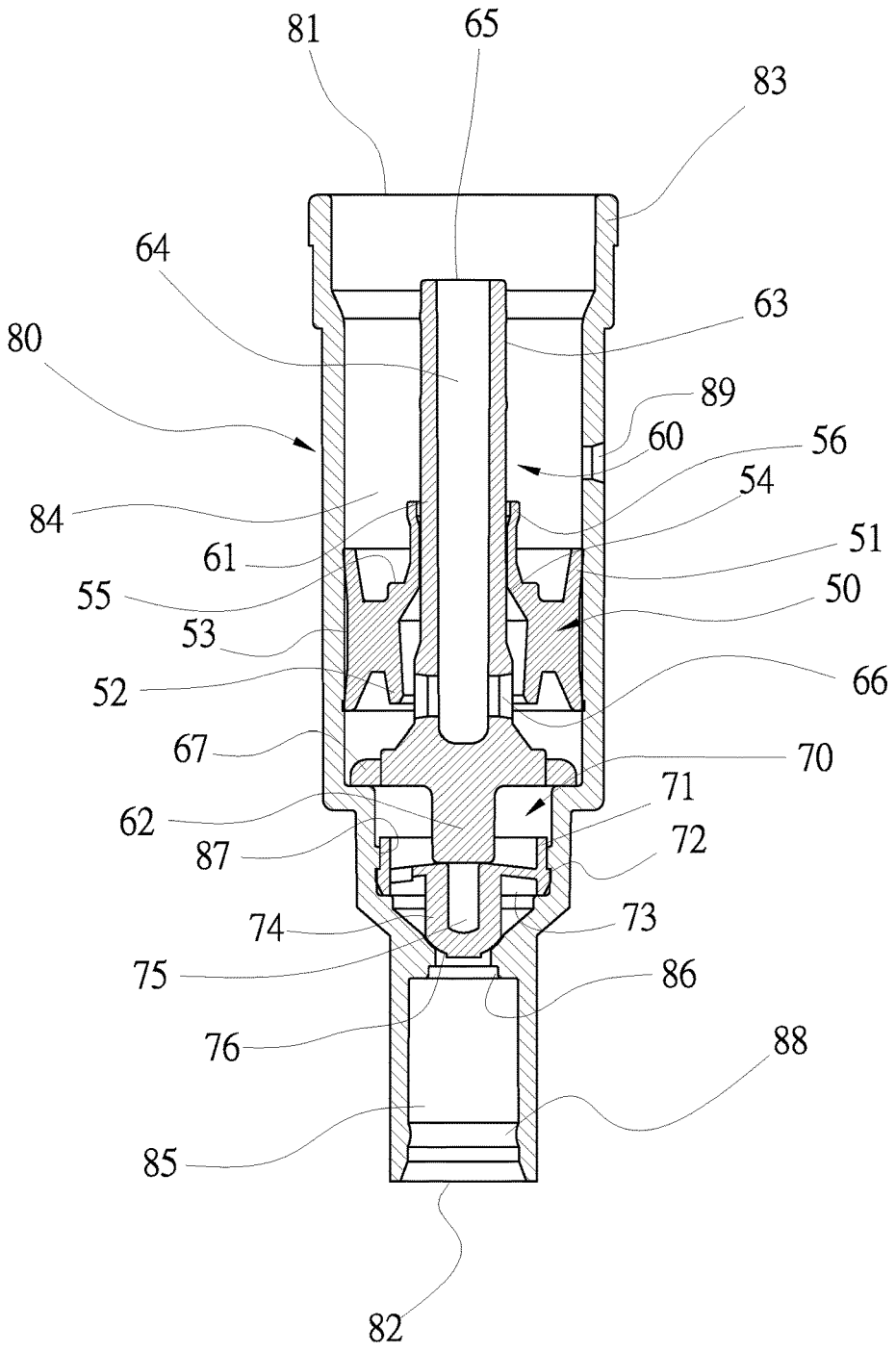

Referring to FIG. 4, the piston 50 and the piston rod 60 are movably inserted in the chamber 84 of the cylinder 80 via the open end 81. The hollow section 61 of the piston rod 60 extends throughout the internal annular portion 52, the axial extensive portion 54 and the circumferential expansive portion 56 of the piston 50. The teeth 67 are placed against the shoulder 91 so that the solid section 62 of the piston rod 60 is in slight contact with the plug 74. Hence, the solid section 62 of the piston rod 60 facilitates the plug 74 to block the neck 86. The concave face 53 is in contact with the internal face of the cylinder 80 in the chamber 84 of the cylinder 80 to provide friction between the external annular portion 51 and the cylinder 80 to keep the piston 50 in position in the chamber 84.

Figure 5:
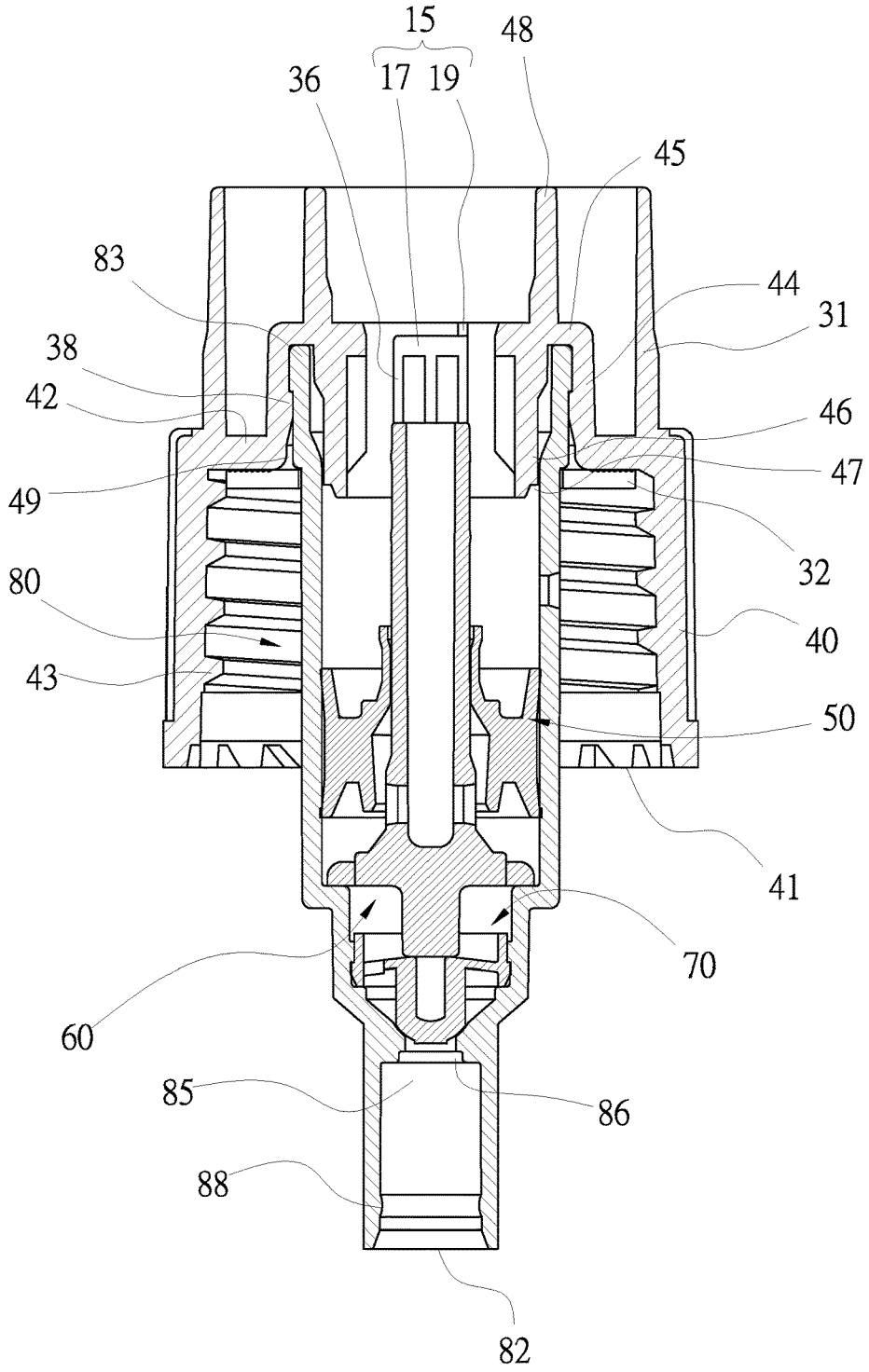

Referring FIGS. 1 and 5, the collar 40 includes two ends 41 and 42 and a thread 43 extending on an internal face. Two walls 31 and 44 extend from the end 42 of the collar 40 so that the walls 31 and 44 are located out of the collar 40. The wall 31 extends around the wall 44. The tubular insert 46 and the walls 31 and 44 extend coaxially. A containing space 49 is made between the wall 44 and the tubular insert 46. An annular rib 38 is formed an internal face of the wall 44. The collar 40 further includes an annular portion 45 formed at an end of the wall 44. A tubular insert 46 extends in the wall 44 from a face of the annular portion 45 of the collar 40. The tubular insert 46 further includes a concave face 47 made in a free end. A socket 48 is provided at another face of the annular portion 45 of the collar 40. The collar 40 further includes rectilinear ribs 36 extend on an internal face of the tubular insert 46 for reinforcement thereof.

The washer 32 is inserted in the collar 40 via the end 41 so that it is placed against the end 42. A portion of the cylinder 80 that extends around the open end 81 is inserted in the containing space 49. Together, the piston 50, the piston rod 60, the elastic valve 70 and the cylinder 80 are moved so that the annular flange 83 is moved throughout the washer 32 and engaged with the annular rib 38 to keep the collar 40 partially in the cylinder 80. The annular portion 45 of the collar 40 shields the cylinder 80. The tubular insert 46 is inserted in the chamber 84 via the open end 81.

The pipe 20 includes a channel 21 that includes an exit 22 in an end, an entrance 23 in another end, a reduced section 24 near the exit 22, an enlarged section 25 in communication with the entrance 23, and an intermediate section 26 between the reduced section 24 and the enlarged section 25. Two ribs 27 extend on an internal face of the intermediate section 26 of the pipe 20. Moreover, the pipe 20 includes an annular flange 28 on an external face.

Figure 6:
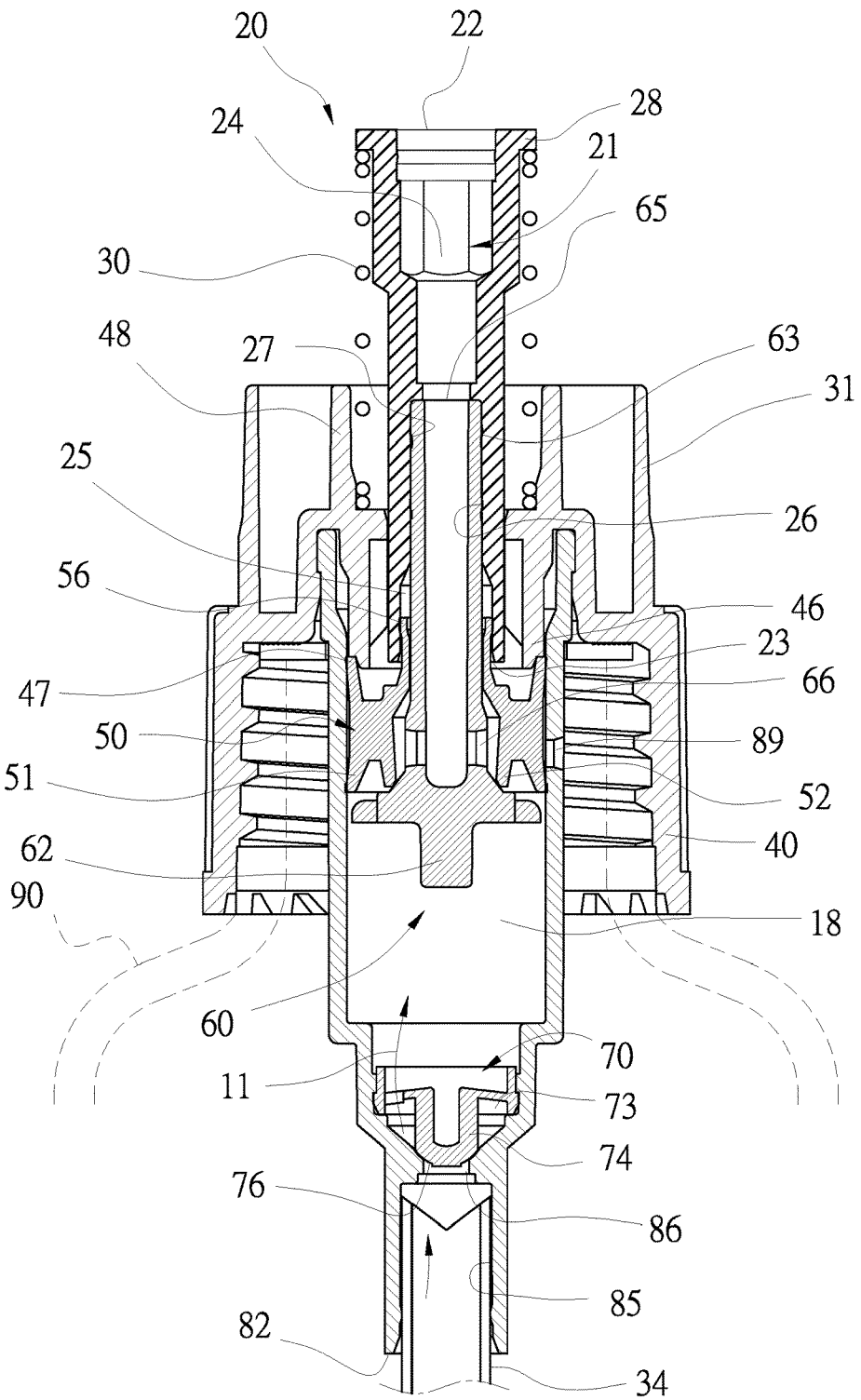

Referring to FIGS. 1 and 6, the spring 30 is preferably a helical compression spring. The pipe 20 is inserted in the tubular insert 46 via the spring 30. The spring 30 includes an end inserted in the socket 48 and another end placed against the annular flange 28. The pipe 20 is biased from the collar 40 by the spring 30.

The piston rod 60 is inserted in the channel 21 through the entrance 23, the enlarged section 25 of the channel 21 and the intermediate section 26. The rib 63 is engaged with the rib 27 to connect the pipe 20 to the piston rod 60. Thus, the exit 65 is in communication with the reduced section 24 of the channel 21. Moreover, there is a space 18 between the piston 50 and the plug 74 or between the piston 50 and the elastic valve 70.

The collar 40 is connected to an open end of a bottle 90 so that the tube 34 includes an end inserted in the chamber 85 of the cylinder 80 via the open end 82. The annular rib 88 squeezes the tube 34 so that the tube 34 extends into the bottle 90 but does not fall. Now, the pipe 20 is pushed several times to determine whether the pump works properly to dispense liquid from the bottle 90.

Figure 7:
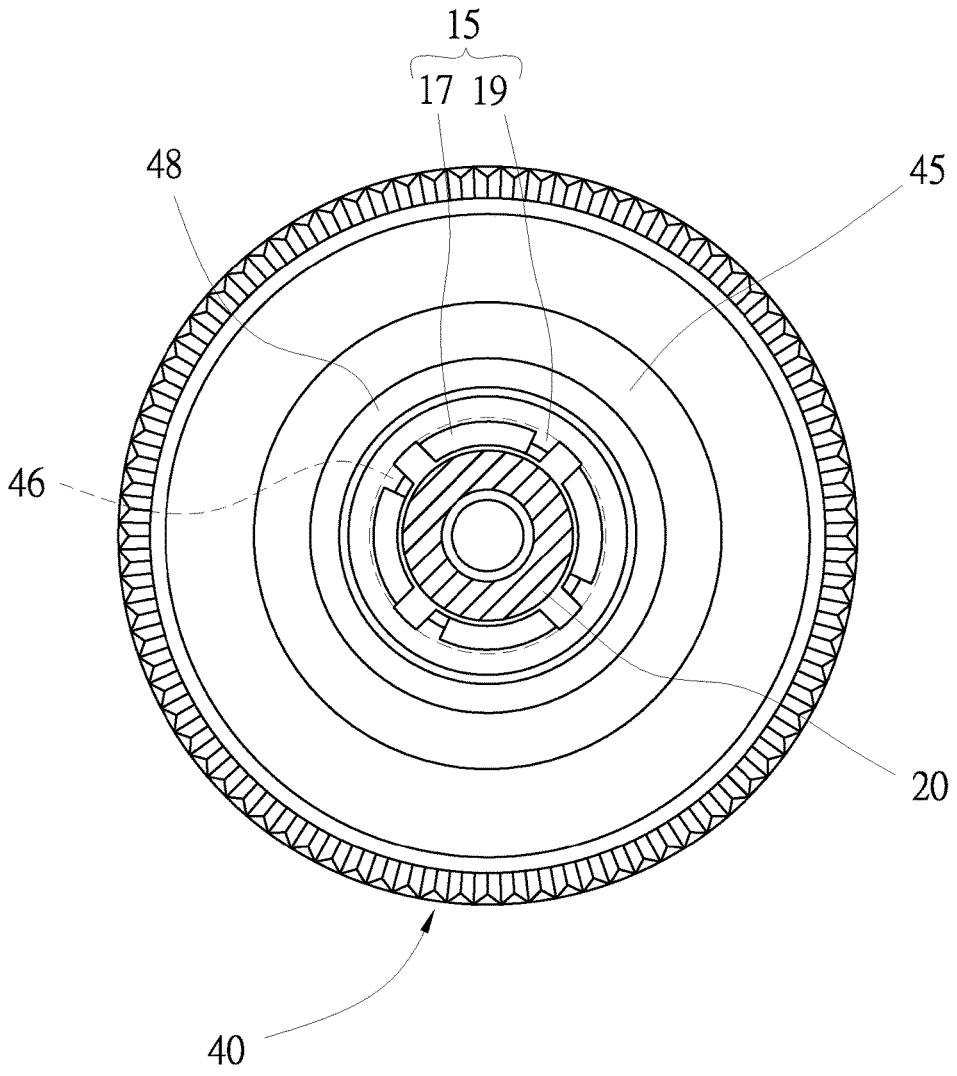
FIG. 7 is a cross-sectional view of the pump shown in FIG. 1.

Referring to FIG. 7, there is a gap between the pipe 20 and the sealing units 15, the connective portion 45 or the tubular insert 46 to allow air enter to enter the collar 40 via this gap.

Figure 8:
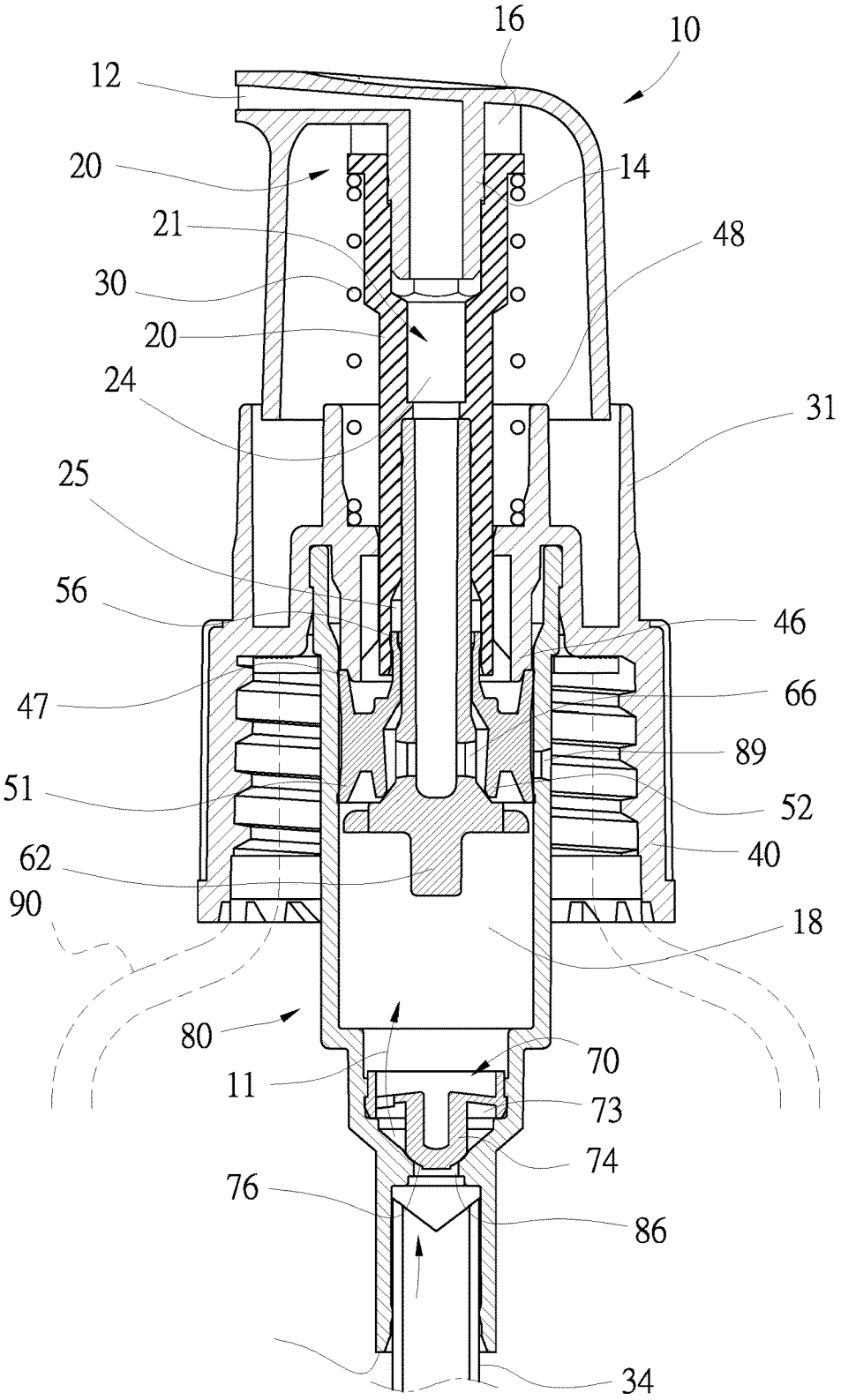
FIG. 8 is another cross-sectional view of the pump shown in FIG. 1 used with a bottle.

Referring to FIGS. 1 and 8, the nozzle 10 is in the form of a cap made with diameter larger than that of the socket 48 but smaller than that of the wall 31. The nozzle 10 is formed with a sprout 12, a connective tube 14 and a stop 16. The sprout 12 gets narrower to the interior of the nozzle 10 from the exterior of the nozzle 10. The connective tube 14 is in communication with the sprout 12 in the nozzle 10. The stop 16 extends around the connective tube 14.

The connective tube 14 is inserted in the channel 21 through the exit 22 so that the sprout 12 is in communication with the channel 21 via the connective tube 14. The annular flange 28 of the pipe 20 is placed against the stop 16.

In a dispensing process, the nozzle 10 is pressed, i.e., moved toward the collar 40. In a refill process, the spring 30 moves the nozzle 10 to the original position, i.e., away from the collar 40.

Figure 9:
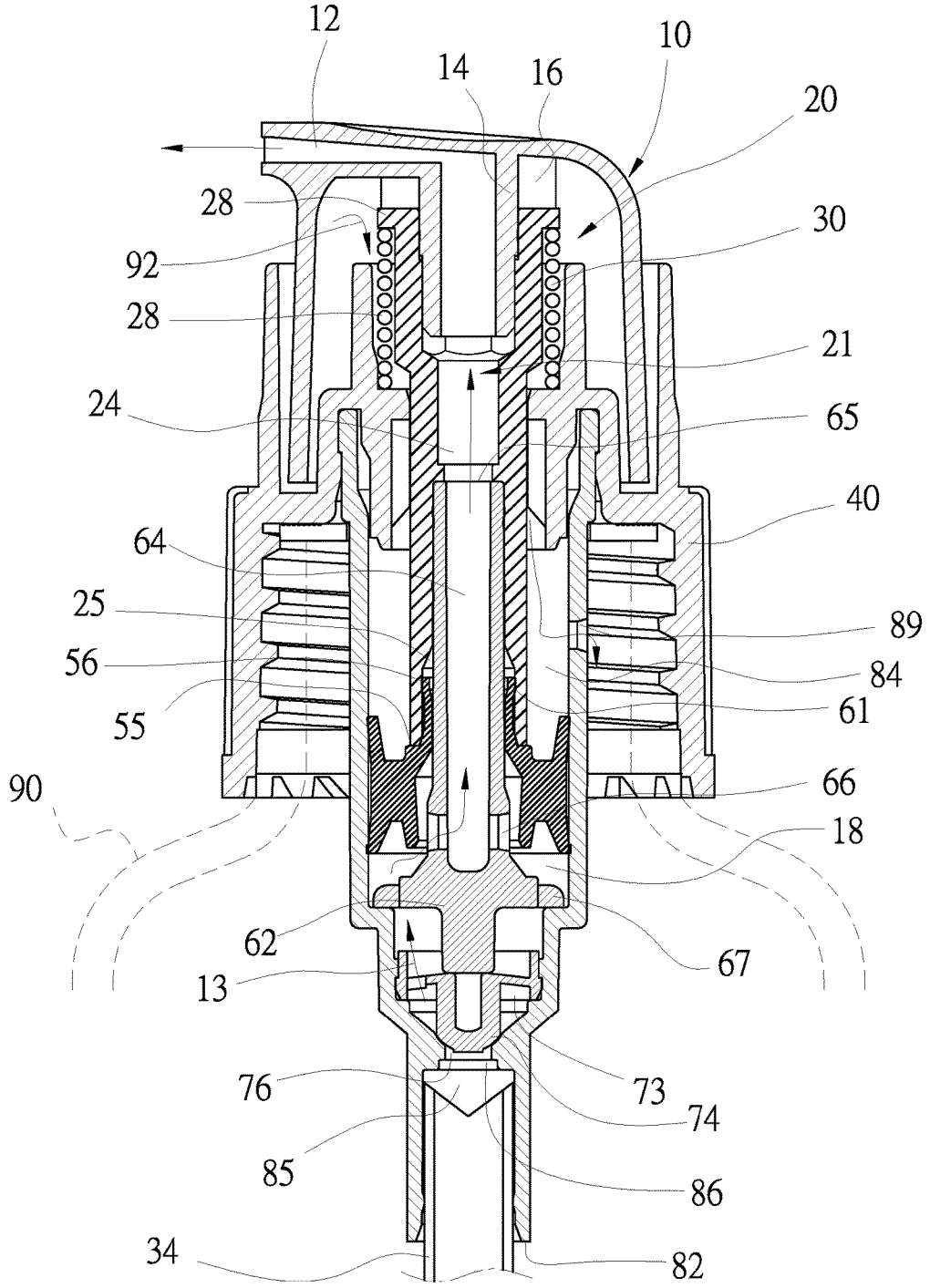
FIG. 9 is a cross-sectional view of a pump according to the second embodiment of the present invention.

Referring to FIGS. 1 and 9, in the dispensing process, the nozzle 10 is pushed toward the collar 40. Thus, the piston rod 60 is moved toward the elastic valve 70 by the pipe 20. Finally, the solid section 62 is placed against the plug 74, and the pipe 20 is in contact with the shoulder 55 so that the piston 50 is moved to the elastic valve 70 by the pipe 20. The volume of the space 18 is reduced to cause liquid to travel via gaps between the elastic strips 73 and gaps between the teeth 67 and enters the channel 64 via the entrances 66 as indicated by an arrow head 13. Finally, the liquid is dispensed from the sprout 12 of the nozzle 10 via the reduced section 24 of the channel 21 and the connective tube 14.

The spring 30 is compressed between the annular flange 28 and the annular portion 45 of the collar 40. The vent 89 of the cylinder 80 is not closed by the external annular portion 51 of the piston 50. Thus, air is allowed to enter the bottle 90 via the nozzle 10, the gap between the pipe 20 and the collar 40 and the vent 89 of the cylinder 80 as indicated by an arrow head 92 to increase the volume of the bottle 90 again.

In the dispensing process, three check valves come to work. The first check valve is made by the plug 74 and the neck 86. Normally, the plug 74 is supported by the elastic strips 73, and the neck 86 is blocked by the convex face 76. Thus, the liquid cannot enter the chamber 85 of the cylinder 80 via the tube 34. The solid section 62 exerts an adequate force to press the plug 74 against resistance from the liquid even if the liquid is sticky or includes particles that could otherwise cause trouble for the plug 74 blocking the neck 86. Moreover, the efficiency of the convex face 76 blocking the neck 86 is increased.

The second check valve is made of the circumferential expansive portion 56 of the piston 50 and the portion of the pipe 20 that extends around the enlarged section 25 of the channel 21. In the dispensing process, the circumferential expansive portion 56 of the piston 50 is in contact with the pipe 20 so that the liquid cannot enter the space between the piston 50 and the tubular insert 46 from the space 18.

The third check valve is made of the portion of the pipe 20 around the entrance 23 and the shoulder 55 of the piston 50. The pipe 20 rubs against the shoulder 55. Thus, the third check valve cooperates with the second check valve to keep the liquid from space 18 out of the space between the piston 50 and the tubular insert 46.

Referring to FIGS. 1 and 8, in the refill process, the nozzle 10 is returned to the original position by the spring 30. The force loaded in the spring 30 is larger than the friction between the concave face 53 of the external annular portion 51 and the cylinder 80 so that the piston rod 60 is returned to its original position with the pipe 20. The solid section 62 pushes the piston 50 by the internal annular portion 52 so that the external annular portion 51 is inserted in the concave face 47 of the tubular insert 46.

Now, the vent 89 of the cylinder 80 is blocked by the external annular portion 51 of the piston 50. Thus, air cannot enter the bottle 90 from the exterior. The entrances 66 of the piston rod 60 are blocked by the internal annular portion 52 of the piston 50, which is placed against the solid section 62. The travel of the liquid into the channel 64 is interrupted.

Particularly, the solid section 62 no longer presses the plug 74 of the elastic valve 70. Thus, the volume of the space 18 is increased because the piston 50 is moved away from the elastic valve 70, thereby sucking the plug 74 against the elastic strips 73. The convex face 76 of the plug 74 is moved away from the neck 86. The first check valve does not block the pump. Hence, liquid can enter the chamber 85 of the cylinder 80 from the bottle 90 via the tube 34 as indicated by an arrow head 11, and the volume of the space 18 is increased.

In the refill process, with the first check valve disabled, the pipe 20 of the third check valve is away from the shoulder 55, not being able to prevent leak. However, the second check valve continues to prevent leak because the circumferential expansive portion 56 is still in contact with the pipe 20. The second check valve is used with a fourth check valve to effectively prevent leak. The fourth check valve is made of an edge of the external annular portion 51 of the piston 50 in contact with the concave face 47 of the tubular insert 46. Thus, the second and fourth check valves together keep the liquid from the space 18 out of the space between the piston 50 and the tubular insert 46.

Figure 10:
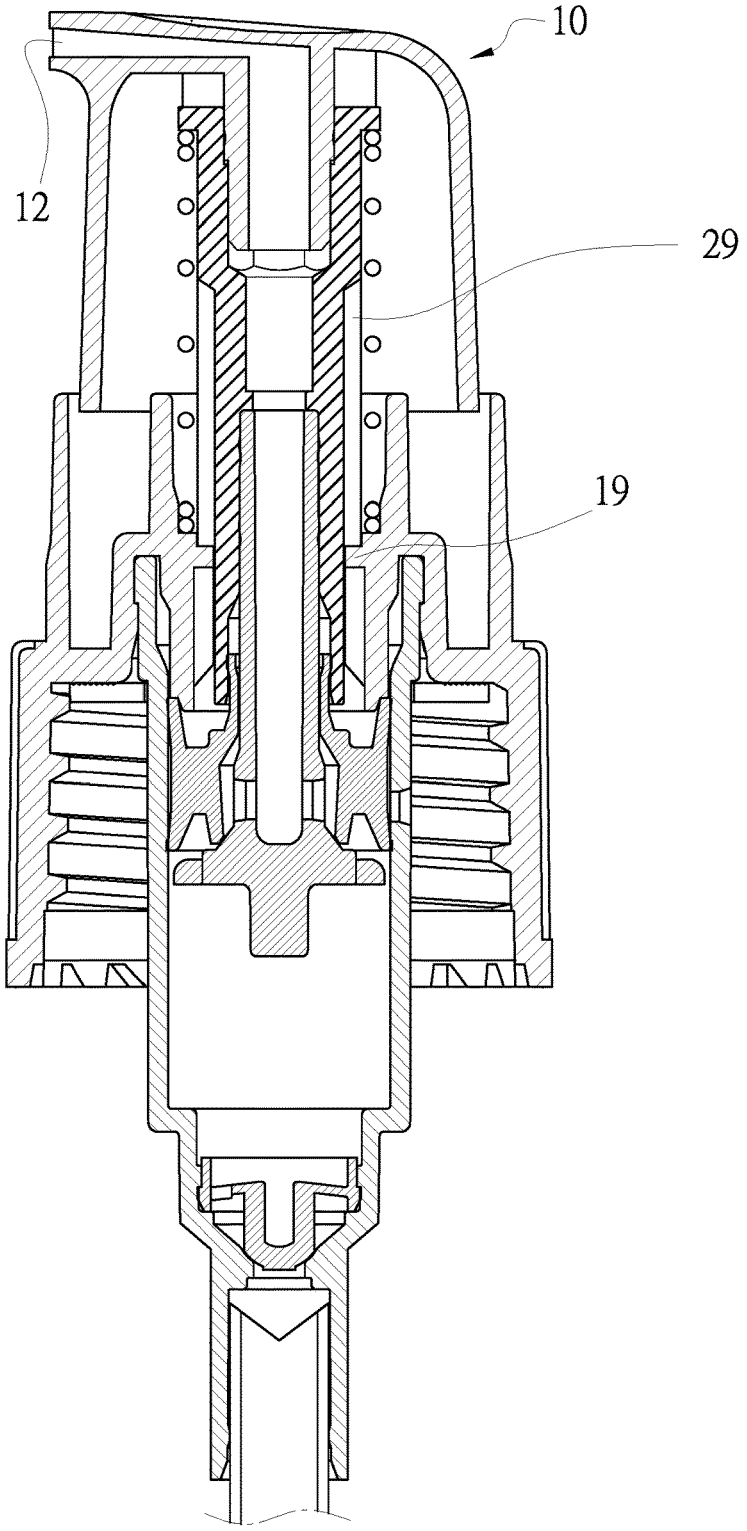
FIG. 10 is a cross-sectional view of the pump in another position than shown in FIG. 9.
Figure 11:
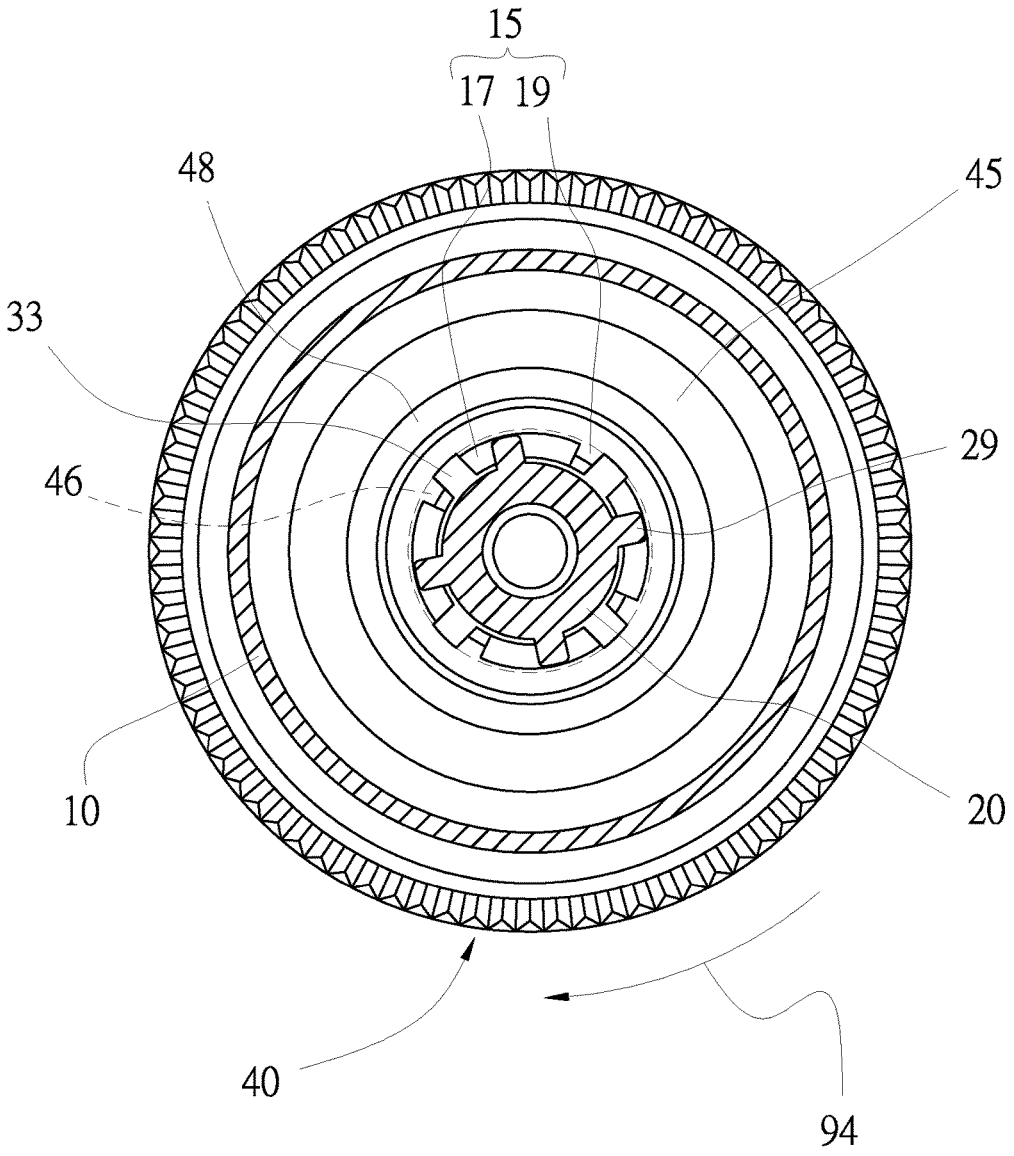
FIG. 11 is a cross-sectional view of the pump in another position than shown in FIG. 10.

Referring to FIGS. 10 and 11, there is a pump according to a second embodiment of the present invention. The second embodiment is like the first embodiment except for several things. Firstly, the pipe 20 further includes several restraints 29 formed on an external face. Secondly, the collar 40 further includes sealing units 15 formed on the internal face and gaps 33 each between two adjacent ones of the sealing units 15. Each of the sealing units 15 includes a track 17 and a restraint 19. The track 17 is an arched strip extending on the internal face of the collar 40. The restraint 19 is in the form of a block formed on an upper face of the track 17.

Each of the rectilinear ribs 36 is inserted in the gap 33 between two adjacent ones of the sealing units 15, without interfering with the movement of the nozzle 10 and the pipe 20 relative to the collar 40. If necessary, the nozzle 10 is moved as indicated by an arrow head 94. Thus, the pipe 20 is rotated in a same sense of direction so that the rectilinear ribs 36 are stopped by the restraints 19. The rectilinear ribs 36 are placed on the tracks 17 so that the sealing units 15 are in the way of the movement of the restraint 29 and that the nozzle 10 is kept in the refill process. The nozzle 10 can be rotated in an opposite sense of direction relative to the collar 40 to allow the movement of the nozzle 10 relative to the collar 40. Thus, the nozzle 10 can be pressed.

The present invention has been described via illustration of the embodiments. Those skilled in the art can derive variations from the embodiments without departing from the scope of the present invention. Therefore, the embodiments shall not limit the scope of the present invention defined in the claims.

The invention claimed is:

1. A pump comprising:

a collar comprising a wall, a tubular insert extending in the wall, and a connective portion formed between the wall and the tubular insert;

a cylinder comprising a first open end, a second open end, a first chamber in communication with the first open end, a second chamber in communication with the second open end, and a neck in communication with the first and second chambers;

an elastic valve comprising a ring, a plug extending in the ring, and elastic strips formed between the plug and the ring so that the plug is axially movable relative to the ring;

a nozzle comprising a tube extending therein and a spout in communication with the tube;

a pipe formed with a channel comprising an exit and an entrance;

a piston comprising an external annular portion, an internal annular portion extending in the external annular portion, an axial extensive portion axially extending from the internal annular portion, an circumferential expansive portion transversely extending from the axial extensive portion, and a shoulder formed between the internal annular portion and the axial extensive portion; and a piston rod comprising a solid section and a hollow section extending from the solid section and comprising a channel made with an exit near an end and entrances near another end;

wherein the tubular insert is inserted in the first chamber via the first open end when the cylinder is connected to the wall, and the plug normally blocks the neck to form a first check valve when the elastic valve is connected to the second chamber;

wherein the pipe is connected to the tube of the nozzle to communicate the channel with the spout when the exit is pointed at the tube;

wherein the hollow section extends throughout the internal annular portion of the piston;

wherein the piston and the piston rod are inserted in the chamber of the cylinder to provide a space between the piston and the elastic valve to allow connection of the hollow section to the channel of the pipe;

wherein the solid section presses the plug of the first check valve to block the neck when the nozzle is moved toward the collar in a dispensing phase.

2. The pump according to claim 1, wherein the plug comprises, at an end, a convex face for blocking the neck.

3. The pump according to claim 1, wherein the circumferential expansive portion of the piston contacts a portion of an internal face of the pipe to form a second check valve to avoid leak from the space in the refill phase and the dispensing phase.

4. The pump according to claim 1, wherein the pipe comprises a terminal portion extending around the entrance and abutting against the shoulder of the piston to form a third check valve to avoid leak in the dispensing phase.

5. The pump according to claim 1, wherein the tubular insert comprises a concave face in contact with the external annular portion of the piston to form a fourth check valve in the refill phase.

6. The pump according to claim 1, wherein the cylinder comprises a vent blocked by the external annular portion of the piston in the refill phase.

7. The pump according to claim 1, wherein the external annular portion of the piston comprises a concave face in contact with an internal face of the cylinder.

* * * * *